United States Patent [19]

Bernhardt et al.

[11] 4,067,086

[45] Jan. 10, 1978

[54] METHOD FOR PROCESSING STAPLE FIBERS ON A ROLLER CARD UNIT

[75] Inventors: Siegfried Bernhardt, Bremen-Farge; Gerhard Kutscher, Bremen, both of Germany

[73] Assignee: Fried. Krupp Gesellschaft mit beschrankter Haftung, Essen, Germany

[21] Appl. No.: 588,175

[22] Filed: June 18, 1975

[30] Foreign Application Priority Data

July 3, 1974 Germany ..... 2431870

[51] Int. Cl.[2] ..... D01G 15/04

[52] U.S. Cl. ..... 19/101

[58] Field of Search ..... 19/98, 99, 100, 101

[56] References Cited

U.S. PATENT DOCUMENTS

| | | | |
|---|---|---|---|
| 709,980 | 9/1902 | Gilljam | 19/100 |
| 1,953,386 | 4/1934 | Bates | 19/99 |
| 2,560,013 | 7/1951 | Varga | 19/100 |
| 2,788,547 | 4/1957 | Kaufman et al. | 19/98 X |
| 3,145,425 | 8/1964 | Varga | 19/98 |
| 3,308,511 | 3/1967 | Culpan | 19/98 X |

FOREIGN PATENT DOCUMENTS

| | | | |
|---|---|---|---|
| 273,799 | 7/1927 | United Kingdom | 19/100 |

*Primary Examiner*—Dorsey Newton
*Attorney, Agent, or Firm*—Spencer & Kaye

[57] ABSTRACT

In a staple fiber card unit composed of a main cylinder and at least one work roller and clearing roller, the output of the unit is maximized by driving the work and clearing rollers at a rate which causes the sum of their peripheral speeds to exceed 250 meters per minute.

3 Claims, 4 Drawing Figures

METHOD FOR PROCESSING STAPLE FIBERS ON A ROLLER CARD UNIT

BACKGROUND OF THE INVENTION

The present invention relates to a method and apparatus for processing staple fibers on a roller card unit of the type provided with a main cylinder and associated pairs of work and clearing rollers.

The output level of a card unit is limited by various factors including particularly the type of fibers to be processed, the degree of separation of the fiber material coming into the card unit, the percentage of waste material in the fibers, the desired quality of the resulting web, the configuration of the cylinder card clothing and the so-called C value of the main cylinder. Optimum setting of the rollers with respect to one another is a prerequisite. The C value, which constitutes the load factor for the cylinder card clothing, must be selected in dependence on the previously mentioned factors.

The carding process which takes place between the work rollers and the main cylinder requires, as a prerequisite for achieving the desired results that the optimum relative speed exist between the work rollers and the main cylinder. This speed depends on the type and length of the fibers.

If it is assumed that the peripheral speed of the main cylinder is adjustable and can be varied between 600 and 1500 m/min, and the peripheral speed of the work rollers can be varied between 5 and 25 m/min, the processing location produces a variation range for the peripheral speed differential of between 24 and 300 times, the two rollers rotating in the same direction.

If it is assumed that the main cylinder always operates with an optimum C value, the work rollers may be loaded very heavily with fibers. This is so because, as mentioned above, the peripheral speed of the work rollers can be varied only between quite defined limits in dependence on the type and length of the fibers. If these limits are exceeded, too many fibers will arrive at the clearing rollers, which rotate with a constant peripheral speed. This again leads to excess quantities of fibers between the clearing rollers and the main cylinder and thus to a poor web quality.

Poor web quality in high production output installations where the work rollers are too heavily loaded with fibers may also have its origin in the fact that the clearing rollers remove the fiber fleece from the work rollers in batches and feed it to the main cylinder in the same manner. This then results in a final fiber web which is fleecy, or cloudy.

In the above-mentioned exceptional cases, there exists the possibility of increasing the peripheral speed of the work rollers, when they rotate in a direction such that their peripheries advance in the same direction as the periphery of the main cylinder at the work location in question so that the condensing ratio between the work rollers and the main cylinder is reduced down to 1:6. The condensing ratio is the value given by the ratio "peripheral speed of the work rollers/peripheral speed of the main cylinder".

In that case the work rollers carry fewer fibers per unit area but the amount of material put through on the work rollers will nevertheless correspond to the high production output of the card unit. The peripheral speed of the work rollers can be changed in such cases so that the ratio to the peripheral speed of the clearing rollers can be set to a value of 1:1 and even lower. The clearing rollers can then take over a relatively fine and closed fiber web from the work rollers and feed it to the main cylinder.

SUMMARY OF THE INVENTION

The goal of the present invention is to operate a card unit under the most varied starting conditions with the highest possible output and at the same time to produce a good or acceptable web quality.

To this end, it is an object of the present invention to permit the clothing of the work rollers to be optimally loaded within the limits of permissible C values.

According to the invention, the known adjustability of the peripheral speed of the work rollers is utilized to increase output to the extent that the required carding effect between the work rollers and the main cylinder permits the peripheral speed of the work rollers to be varied.

In further accordance with the invention, for certain desired web qualities, the peripheral speed of the work rollers is increased to such an extent that a ratio of that speed to the peripheral speed of the clearing rollers of no more than 1:1 results.

This is accomplished, according to the present invention, by maintaining the peripheral speed of the work rollers and/or the peripheral speed of the clearing rollers high enough so that, on one hand, the clearing rollers are not loaded beyond their highest possible capacity and, on the other hand, the main cylinders, which already is loaded with fibers at the point of discharge to the respective clearing roller, also receives fibers from the clearing rollers only within it highest possible capacity.

More specifically, this is advantageously accomplished by causing the sum of the peripheral speed values of the work roller and the clearing roller of a pair of work and clearing rollers to be greater than 250 m/min. It is here particularly advantageous for the peripheral speed of the clearing roller to be greater than 200 m/min and/or the peripheral speed of the work roller to be greater than 90 m/min.

It has been found, as the result of experiments, that it is particularly advantageous if the maximum possible load on the clothing of the clearing rollers does not exceed a value of, for example 2g/m for fine fibers (1.7 dtex). The dimension "dtex" characterizes the fineness of fibers; it stands for "g fibers/10.000 m fiber length".

The fibers, which under such conditions are better oriented longitudinally in the clearing rollers, are introduced into the main cylinder clothing so that the proportion of fibers reintroduced to the succeeding work roller for recarding is greatly reduced and thus the work rollers are loaded with fewer fibers. The result is that the work roller clothing subjected to a smaller load of fibers can always produce optimum carding work so that the number of processing locations can be reduced with increased material throughput.

In further accordance with the present invention, drive assemblies are arranged to drive the work rollers and clearing rollers so that the sum of the peripheral speeds of the work roller and the clearing roller of one pair of work and clearing rollers attains a value greater than 250 m/min. It is particularly advantageous for the drive assemblies to be specifically constructed so that the clearing rollers can be operated at a peripheral speed of more than 200 m/min and/or the work rollers at a peripheral speed of more than 90 m/min.

The drive assembly can, insofar as concerns the present invention, be any suitable drive which is disposed between the drive motor or the main cylinder shaft, on the one hand, and the work rollers and clearing rollers, on the other hand. This includes toothed gear drives as well as series-connected chain, belt-and-toothed-gear, flat belt and V-belt drives.

Advantageously, the peripheral speed of the clearing rollers themselves is made variable over a continuous range and adjusted in dependence on the material throughput. According to an advantageous embodiment of the present invention, the peripheral speed of the work rollers themselves is also variable independently of the peripheral speeds of the main cylinder and the clearing rollers.

DESCRIPTION OF THE PREFERRED EMBODIMENTS

Figure 1:
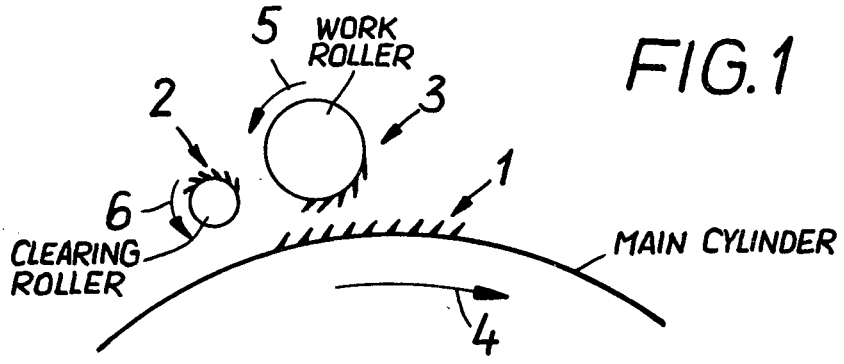
FIG. 1 is a simplified elevational view of the essential components of a preferred embodiment of the invention.

The embodiment shown in FIG. 1 is constituted by a normal arrangement of a work roller and a clearing roller with respect to the main cylinder of a high output card machine. Usually a plurality of pairs of work and clearing rollers are associated with the main cylinder, but only one pair of these rollers is shown. The directions of rotation of the cylinder and the rollers are shown by arrows 4, 5 and 6, respectively. In a known manner, the main cylinder, the clearing roller and the work roller are provided with clothings 1, 2 and 3, respectively, over their peripheries, only part of these clothings being indicated.

Between the main cylinder, which rotates in the direction of arrow 4, and the work roller, which rotates in the direction of arrow 5, the carding process takes place. The fiber material is not shown. The fiber material which is removed by the work roller from the main cylinder is fed back to the main cylinder by means of the clearing roller, which rotates in the direction of arrow 6. The mode of operation of the main cylinder with its pairs of work and clearing rollers is known in principle and, since it is already known in the art, need not be explained in detail.

Figure 2:
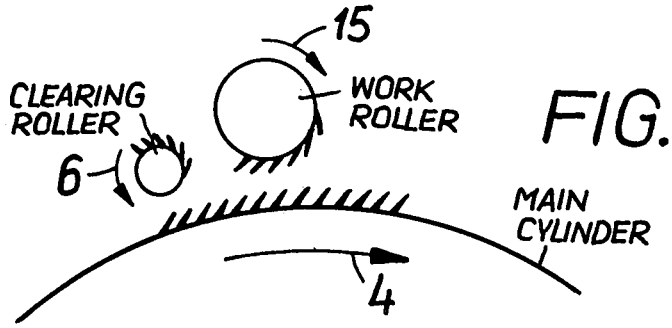
FIG. 2 is a view similar to that of FIG. 1 of a second embodiment of the invention structurally similar to the embodiment of FIG. 1.

The embodiment illustrated in FIG. 2 differs from that of FIG. 1 in that the work roller rotates in a direction, shown by arrow 15, opposite to the direction of rotation of the main cylinder.

Figure 3:
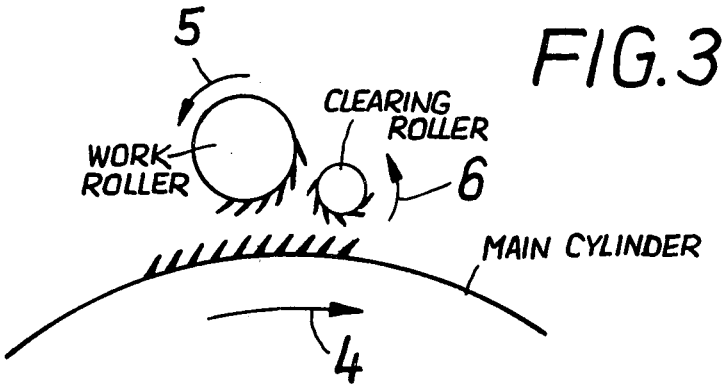
FIG. 3 is a view similar to that of FIG. 1 of a further embodiment of the invention.

In the embodiment of FIG. 3, the clearing roller is disposed behind the work roller, when looking in the direction of rotation of the main cylinder. Otherwise the directions of rotation are the same as in the normal arrangement of FIG. 1.

According to the process of the present invention the sum of the peripheral speeds of the work roller and the clearing roller of one pair of work and clearing rollers in all three of the arrangements shown in FIGS. 1 to 3 is greater than 250 m/min. It is particularly advantageous for the peripheral speed of the clearing roller to be greater than 200 m/min and/or the peripheral speed of the work roller to be greater than 90 m/min.

Figure 4:
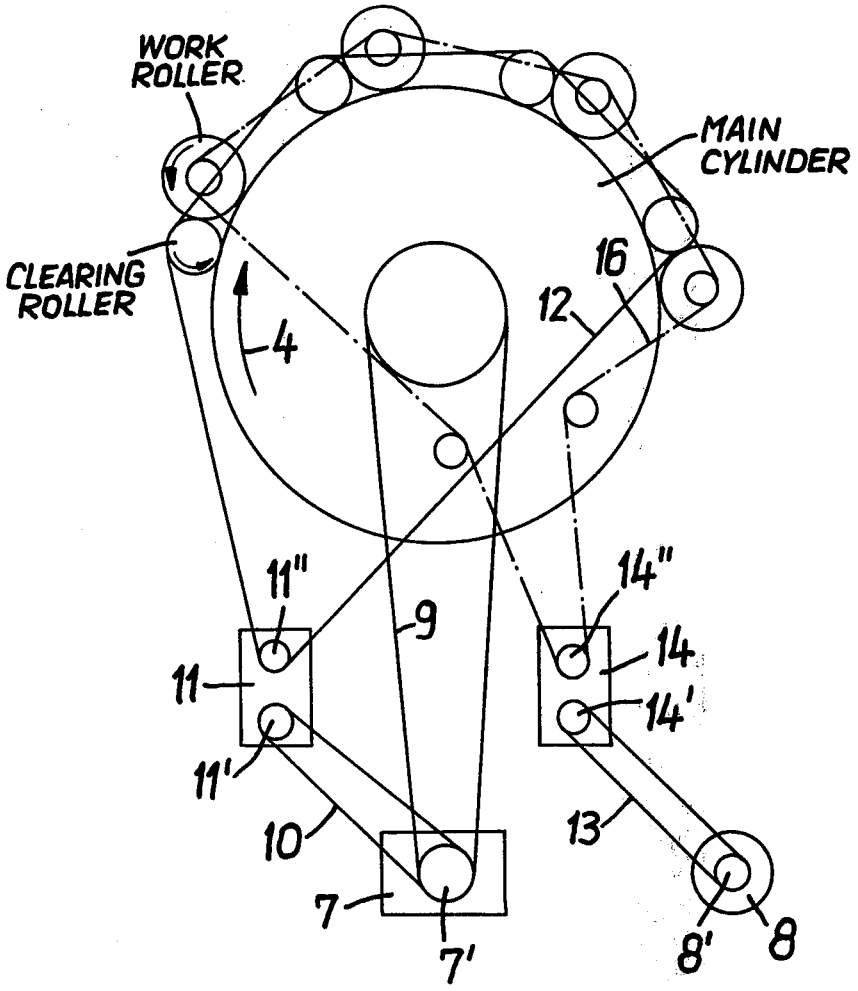
FIG. 4 shows a drive assembly for the main cylinder, the work rollers and the clearing rollers.

According to the embodiment of FIG. 4, the roller card unit is provided with two separate driving motors, namely the main driving motor 7 and the driving motor 8.

The driving shaft 7' of motor 7 is connected to the main cylinder T via a driving belt 9 and to the entry shaft 11' of an adjustable gear 11 via a driving belt 10. The driving shaft 11'' of the adjustable gear 11 is connected to the four clearing rollers via a driving belt 12. By that the peripheral speed of the clearing rollers is made variable and independent of the speed range of the main driving motor 7.

The driving shaft 8' of motor 8 has connection to the entry shaft 14' of an adjustable gear 14 via a driving belt 13. The work rollers are therefore driven in an adjustable manner by by motor 8, and that by interconnection of a driving belt 16 associated to the driving shaft 14'' of the adjustable gear 14.

The speed to the driving shaft 7' and 8' equally may be adjustable.

The embodiment of FIG. 4 may be varied by using only one motor, for example the motor 7, the driving belt 13 being connected to the driving shaft 7'.

If only the peripheral speed of the clearing rollers has to be adjustable, there is no need of the adjustable gear 14. In this case, the driving belt 16 is directly driven by the driving shaft 7' of motor 7.

In an embodiment of the roller card unit the main cylinder, the work rollers and the clearing rollers may have a diameter of 1,000 mm, 250 mm and 120 mm, respectively. The corresponding peripheral speeds are 1,000 m/min., 120 m/min. and 200 m/min., respectively.

The roller card unit having for example four work rollers and four clearing rollers and an effective roller length of 2 m is able to bring forth a production of about 100 kg/*h*, the carding material being fine fibers (1.7 dtex).

The main cylinder may have a peripheral speed which lies in a range between 600 m/min. and 1400 m/min.

The maximum value of the peripheral speed of the work rollers and the clearing rollers depends on the dimensions and on the vibration characteristic of these rollers.

The sum of the peripheral speeds of a work roller and the associated clearing roller being greater than 250 m/min. may be achieved by exchanging the speeds of the respective rollers. For example, good results can be achieved, if the peripheral speed of the work rollers and of the clearing rollers is 80m/min. and 250 m/min., respectively, or 140 m/min. and 170 m/min., respectively. These values are preferred for fine fibers. For thick fibers the speed of the said rollers is preferably lower, so that the sum of the peripheral speeds has a value near to 250 m/min.

A roller card unit of prior art is described in the German specification No. 1,006,763, for example.

It will be understood that the above description of the present invention is susceptible to various modifications, changes and adaptations, and the same are intended to be comprehended within the meaning and range of equivalents of the appended claims.

What is claimed is:

1. In a method for processing staple fibers on a roller card unit composed of a rapidly rotating main cylinder and a plurality of pairs of rollers, each pair being constituted by a work roller and a clearing roller associated therewith, which method includes rotating the main cylinder and the rollers at speeds such that the peripheral speed of the main cylinder is higher than that of each of the rollers and the peripheral speed of each of the clearing rollers is higher than that of the work roller of the same pair, and rotating the rollers at speeds sufficient to cause the sum of the peripheral speeds of the work roller and the clearing roller of each pair to be greater than 250 m/min, the improvement wherein said step of rotating the rollers comprises rotating each said work roller at a rate corresponding to a peripheral speed of greater than 90 m/min.

2. Method as defined in claim 1 wherein said step of rotating the rollers further comprises rotating each said clearing roller at a rate corresponding to a peripheral speed of greater than 200 m/min.

3. A method as defined in claim 1 wherein said step of rotating the main cylinder is carried out to give the main cylinder a peripheral speed of between 600 and 1500 m/min.

* * * * *